US006305992B1

(12) United States Patent
Bouda et al.

(10) Patent No.: US 6,305,992 B1
(45) Date of Patent: Oct. 23, 2001

(54) ELECTRICAL CONNECTOR HAVING A HOUSING AND AN ELECTRICAL CONTACT AND ELECTRICAL CONTACT

(75) Inventors: Harald Bouda, Haibach; Horst Gehrke, Langen; Günther Mumper, Weiterstadt, all of (DE)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/077,814

(22) PCT Filed: Oct. 16, 1997

(86) PCT No.: PCT/IB97/01284

§ 371 Date: Jun. 4, 1998

§ 102(e) Date: Jun. 4, 1998

(87) PCT Pub. No.: WO98/18181

PCT Pub. Date: Apr. 30, 1998

(30) Foreign Application Priority Data

Oct. 17, 1996 (EP) ..... 96116685

(51) Int. Cl.[7] ..... H01R 13/33
(52) U.S. Cl. ..... 439/834
(58) Field of Search ..... 439/839, 851, 439/845, 843, 862, 66

(56) References Cited

U.S. PATENT DOCUMENTS

| | | | | |
|---|---|---|---|---|
| Re. 27,463 | * | 8/1972 | Sitzler et al. | 339/59 R |
| 3,781,760 | | 12/1973 | Mancini et al. | 339/59 M |
| 3,836,947 | | 9/1974 | Yeager | 339/259 R |
| 5,281,175 | * | 1/1994 | Chupak et al. | 439/839 |
| 5,468,163 | * | 11/1995 | Egenolf | 439/839 |
| 5,664,972 | * | 9/1997 | Zinn et al. | 439/839 |
| 5,735,717 | * | 4/1998 | Nabeshima | 439/851 |

FOREIGN PATENT DOCUMENTS

| | | | | |
|---|---|---|---|---|
| 44 10 951-A1 | | 12/1994 | (DE) | H01R/13/18 |
| 5835590 A2 | * | 2/1994 | (EP) | 439/839 |
| 54-102590 | | 8/1979 | (JP) | H01R/13/12 |
| 5-48271 | * | 6/1993 | (JP) . | |

OTHER PUBLICATIONS

See PCT International Search Report for any references that are not enclosed herewith.

* cited by examiner

*Primary Examiner*—Paula Bradley
*Assistant Examiner*—Briggitte R. Hammond

(57) ABSTRACT

An electrical contact (1) is shown having a conductor connection region (2) for connection to an electrical conductor wire and a contact-making region (3) for making contact with a complementary contact pin is specified, the contact-making region essentially being designed in the form of a box with two side walls (4, 5), a top wall (6) and a bottom wall (7), the bottom wall (7) and the top wall (6) having a different width in the direction perpendicular to the plug-in direction, in such a way that the side walls (4, 5) run in a manner inclined with respect to the bottom and top walls (6, 7) and with respect to one another.

18 Claims, 6 Drawing Sheets

C-C

D-D

B-B

A-A

B-B

C-C

X

ELECTRICAL CONNECTOR HAVING A HOUSING AND AN ELECTRICAL CONTACT AND ELECTRICAL CONTACT

The invention relates to an electrical connector having a housing and having at least one electrical contact, the housing having at least one chamber for the electrical contact and the electrical contact having a conductor connection region for connection to an electrical conductor wire and a contact-making region for making contact with a complementary contact pin, the contact-making region essentially being designed in the form of a box with two side walls, a top wall and a bottom wall, the top and bottom wall having a different width in the direction perpendicular to the plug-in direction, in such a way, that the side walls run in a manner inclined with respect to the bottom and top walls and with respect to one another.

Furthermore, the invention relates to an electrical contact having a conductor connection region for connection to an electrical conductor wire and having a contact-making region for making contact with a complementary contact pin, the contact-making region comprising the following features:

- the contact-making region is essentially designed in the form of a box with two side walls, a top wall and a bottom wall,
- the contact-making region has at least one contact spring arm, which extends away from the conductor connection region;
- the contact-making region has a supporting spring arm, which extends away from the conductor connection region and rests externally on the contact spring arm.

U.S. Pat. No. 5,281,175 discloses an electrical female contact having the above features. The document relates to an electrical female, box-shaped contact with a resilient contact arm in the top wall with a supporting spring and a raised portion on the bottom wall. The contact is designed to receive different thicknesses of mating male terminals. It has a vertically extending tab for guidance in a housing. It is designed as a one part contact, may have an insertion funnel and is essentially rectangular in cross-section.

U.S. Pat. No. 3,836,947 also discloses a female electrical contact with a contact-making region with an essentially rectangular cross-section. One side of this region is in the form of a resilient leaf contact spring and a supporting spring overlying the contact spring.

DE 44 10 951 A1 concerns a flat spring contact, which has a contact-making region in the form of a box in which two contact springs are formed on one side wall, and a supporting spring, which rests on the said contact springs, is an independent part and is connected to the contact-making region by fixing aids. Inwardly embossed contact points are provided on the side opposite to the contact springs.

U.S. Pat. No. Re 27,463 discloses a connector block for receiving and removably holding an electrical contact in a cavity. The cavities are rectangular in cross-section. Female contacts having a conductor connection region and a contact-making region are inserted into the cavities. The contact-making region of the contacts is essentially box-shaped and has the form of a trapezium in its cross-section perpendicular to the plug-in direction. The contacts and the connector block do not seem to have any polarising possibilities.

The object of the invention is to specify an electrical connector which, given a predetermined width of contact pins or blades and minimum contact pin or blade spacings of a mating connector, nevertheless permits reliable construction of robust chamber walls. In addition, it is intended to specify an electrical contact which is suitable for such an electrical connector.

The object is achieved by means of a connector comprising a housing and at least one electrical contact, the housing having at least one chamber for accommodating the electrical contact, the electrical contact having a conductor connection region for connection to an electrical conductor wire and a contact-making region for making contact with a complementary contact pin or blade, the contact-making region essentially being designed in the form of a box with two side walls, a top wall and a bottom wall, the bottom wall and the top wall having a different width in the direction perpendicular to the plug-in direction, in such a way that the side walls run in a manner inclined with respect to the bottom and top walls and with respect to one another, at least one chamber being trapezoidal in its cross-section.

Furthermore, the object of the invention is to specify an electrical contact which permits contact to be made reliably with contact pins or blades whose thickness can be varied within specific tolerances.

The object is achieved by means of an electrical contact having a conductor connection region for connection to an electrical conductor wire and having a contact-making region for making contact with a complementary contact pin, the contact-making region having the following features:

- the contact-making region is essentially designed in the form of a box with two side walls, a top wall and a bottom wall,
- the contact-making region has at least one contact spring arm, which extends away from the conductor connection region;
- the contact-making region has a supporting spring arm, which extends away from the conductor connection region and rests externally on the contact spring arm, a compensating leaf spring being provided in the contact-making region, on the side opposite to the contact spring arm, and the bottom wall and the top wall) having a different width in the direction perpendicular to the plug-in direction, in such a way that the side wall run in a manner inclined with respect to the bottom and top walls and with respect to one another.

Advantageous developments are specified in each of the subclaims.

As a result of the special design of the electrical contact, namely the trapezoidal cross-section, it is possible to provide, between individual chambers which are designed to accommodate such a contact, chamber walls which are cross-sectionally wider on one side than on the other side. As a result, it is possible to achieve, on the thin side, a minimal wall thickness which acquires the necessary robustness only by virtue of the fact that it is joined to a side wall and merges with a wider chamber wall on the other side.

It is particularly advantageous that the trapezoidal form at the same time may be used as a polarising possibility. The advantage is achieved by providing in cross-section, trapezoidal contacts and chambers.

It is particularly advantageous that the electrical contact has a contact spring arm with a supporting spring, the spring properties of the contact spring being optimised thereby. Because of the trapezoidal form of the contact and the fact that the contact spring arm is arranged in the broader top wall, the spring arm may be broad to achieve high contact forces.

It is furthermore advantageous that a compensating leaf spring is situated on the side opposite to the contact spring.

The spring properties of the contact spring arm and compensating leaf spring are coordinated with one another in such a way that when a contact pin or contact blade is introduced, initially it is mainly the contact spring arm that is deflected. Only when the thickness of the contact pin or contact blade exceeds a specific thickness the compensating leaf spring is also deflected to a greater extent. The possible deflection of the compensating leaf spring is advantageously limited by stops. The compensating leaf spring essentially serves to compensate for tolerances in the thickness of the contact pin or contact blade. The compensating leaf spring is substantially more rigid than the contact spring, which has a large elastic region, but less rigid than simple embossed areas or raised portions which are known from the prior art.

It is furthermore advantageous that an insertion funnel is formed at the front end of the contact, which funnel serves to simplify the insertion of the contact pin or contact blade. This insertion funnel is formed by means of a lug which is bent back from the upper wall of the contact-making region into the interior of the contact-making region. This upper lug can also serve as a stop if the contact spring arm is prestressed.

The conductor connection region can, for example, be designed as two different crimp regions, one for crimping the conductor wire and one for crimping the insulation of the conductor wire. However, it is also possible for the conductor connection region to have an insulation-piercing terminal contact, or even to constitute a combination of insulation-piercing terminal contact and crimp contact.

It is particularly advantageous that the electrical contact described can be designed as a one-part contact. This enables particularly cost-effective production.

An exemplary embodiment of the invention is now explained with reference to the drawings, in which.

Figure 1:
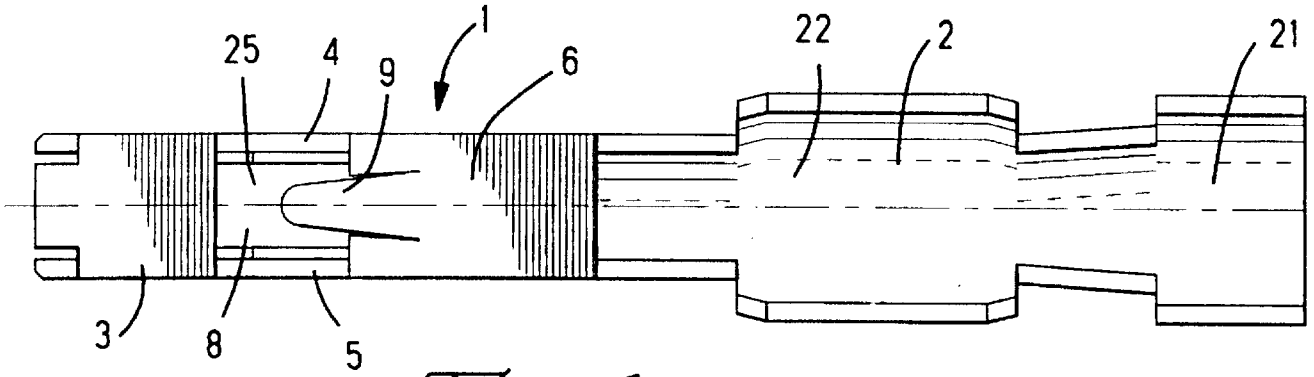
FIG. 1 shows a plan view of an electrical contact.
Figure 2:
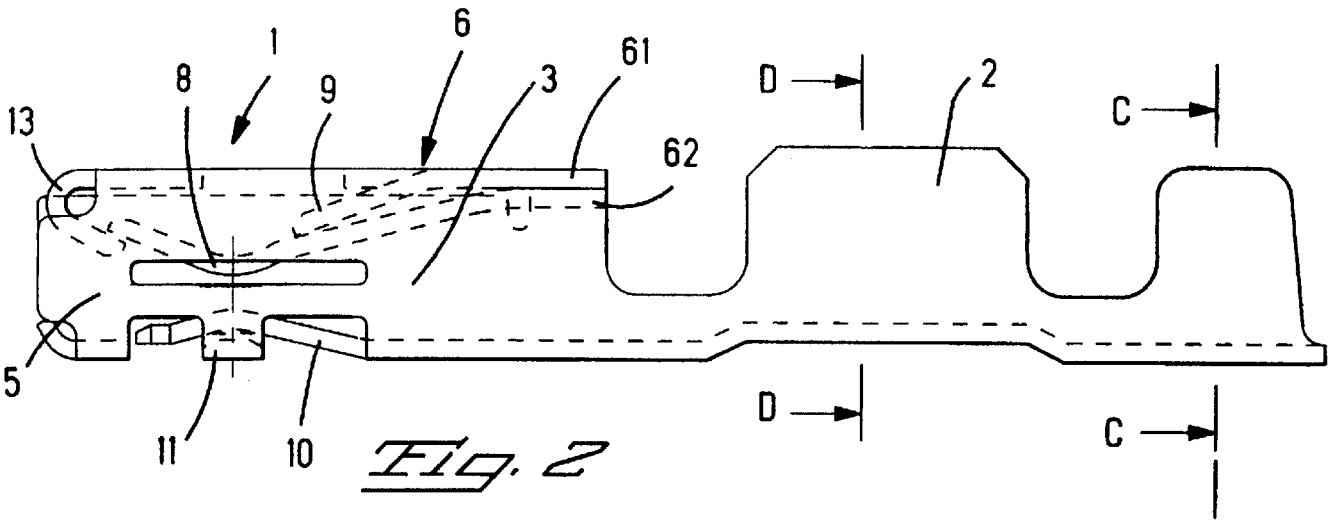
FIG. 2 shows a side view of an electrical contact.
Figure 3:
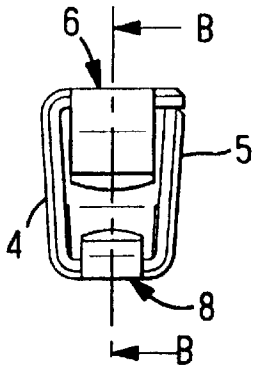
FIG. 3 shows a view of the front end of the electrical contact.
Figure 4:
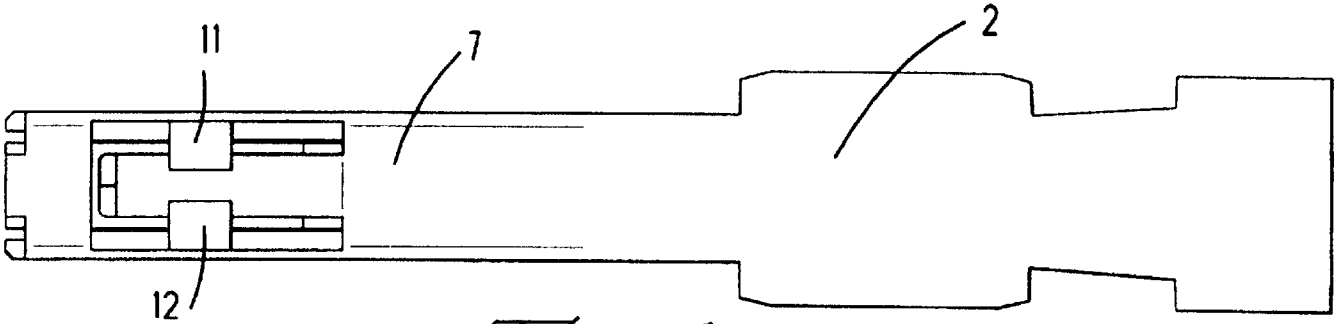
FIG. 4 shows a view from below of the electrical contact.

FIG. 1 illustrates a plan view of a contact 1 according to the invention. The contact comprises a conductor connection region 2 and a contact-making region 3. The conductor connection region 2 serves for connection to an electrical conductor 1 and has two crimp regions, an insulation crimp 21 and a crimp for the electrical conductor wire 22. The contact-making region 3 serves to make contact with a complementary contact pin, the contact pin being introduced into the contact-making region from the front end of the latter. As can be seen particularly clearly in FIG. 2, which illustrates a view from the front end of the contact, the contactmaking region is essentially designed in the form of a box. This box is not rectangular but rather trapezoidal in its cross-section. As can be seen in FIG. 3, the contact-making region 3 has two side walls 4 and 5, a top wall 6 and a bottom wall 7. The bottom wall 7 is in this case designed to be narrower than the top wall 6, thereby achieving the trapezoidal appearance. The two side walls 4 and 5 are therefore arranged such that they are inclined with respect to the top wall and with respect to the bottom wall 7, and they also run in a manner inclined with respect to one another.

Figure 5:
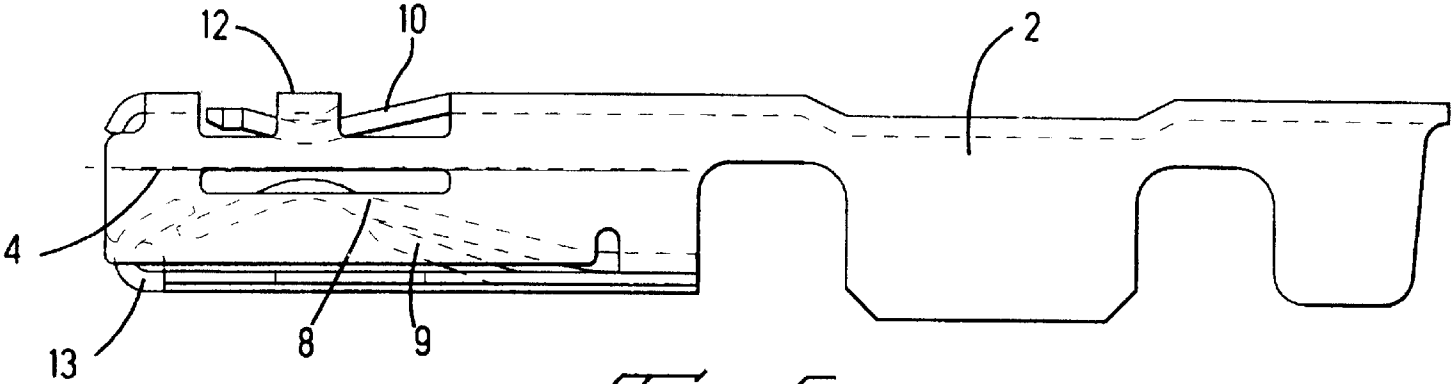
FIG. 5 shows a second side view of the electrical contact.
Figure 7:
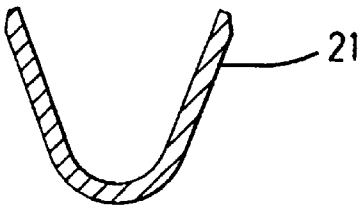
FIG. 7 shows a section through the insulation crimp.
Figure 6:
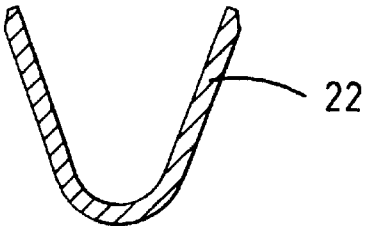
FIG. 6 shows a section through the conductor crimp.

FIG. 1 permits a view of the top wall 6, it also being possible to see the side walls 4 and 5. FIG. 2 shows a view of the side wall 5, and FIG. 5 shows a view of the side arm wall 4. In both illustrations, the contact spring arm 8 is illustrated by dashed lines. The contact spring has a free end at the front end of the electrical contact 1 and is connected to the top wall 6 in the direction of the conductor connection region 2. As is evident from FIG. 2, the top wall comprises two layers 61 and 62 in the region near to the conductor connection region 2. The supporting spring arm 9, which is both shown by dashed lines in the illustrations 2 and 5 and can also be seen in FIG. 1, is bent away from the upper layer 61. The said supporting spring supports the contact spring arm 8, which starts out from the lower layer 62 of the top wall 6. Furthermore, the compensating leaf spring 10 can be seen in the figures. This is a spring which is cut free at one end and extends away from the conductor connection region. The spring is bent inwards, and two stops 11 and 12 start out from the bottom wall 7 and prevent the spring from overstretching. FIGS. 6 and 7 illustrate the sections along the section lines B and D through the two crimp regions. A lug 13 extends forwards from the top wall 6 and is bent inwards into the contact-making region 3. This lug serves as an insertion funnel for the insertion of a complementary contact pin or contact blade.

Figure 8:
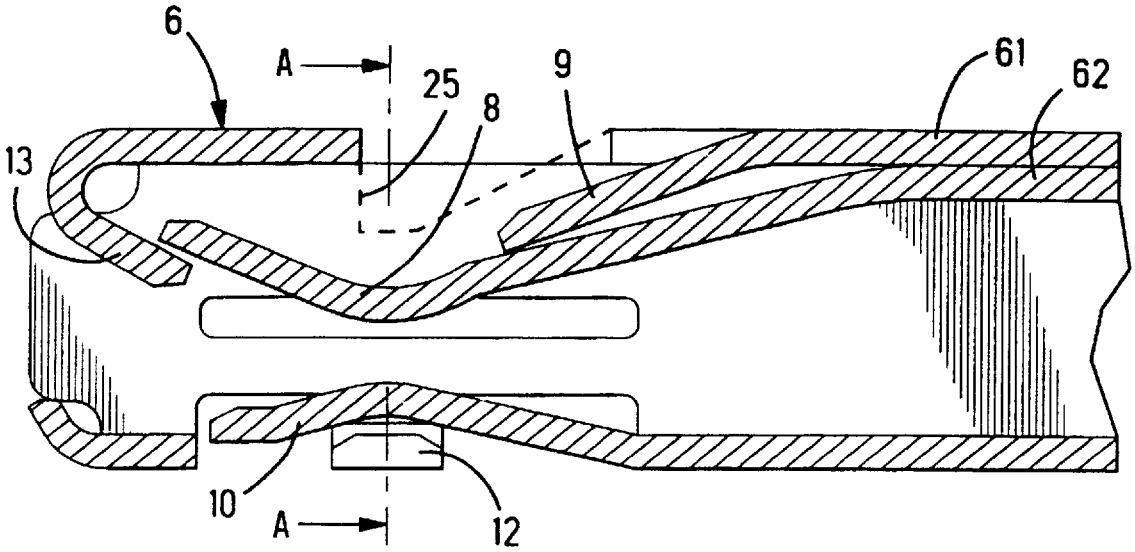
FIG. 8 shows a section along the section line BB according to FIG. 3.

FIG. 8 illustrates a section through the electrical contact 1 along the section line BB according to FIG. 3. The top wall 6 with the two layers 61 and 62 can be seen particularly clearly in this illustration. The arrangement of contact spring arm 8 and supporting spring arm 9, as well as compensating leaf spring 10 and stop 12, also becomes clear here. In the exemplary embodiment illustrated, the contact spring arm 8 is not prestressed, that is to say the lug 13 serves exclusively for forming an insertion funnel. However, it is possible to achieve prestressing of the contact spring arm 8. The lug 13 then likewise serves as a stop for the prestressed contact spring arm 8. The section illustrated also shows the opening 25, in which a latching means (illustrated by dashed lines) can engage in order to hold the contact in a chamber.

Figure 9:
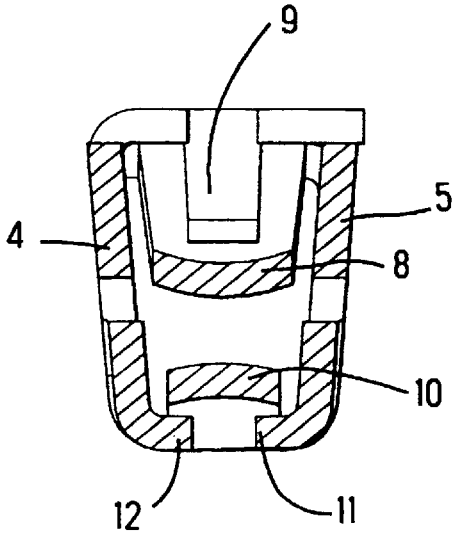
FIG. 9 shows a section along the section line AA according to FIG. 8.

The cross-sectionally trapezoidal contact-making region can be seen clearly once again in FIG. 9, which illustrates a section along the line AA through FIG. 8. The side walls 4 and 5 run in a manner inclined with respect to one another. The compensating leaf spring 10 is situated above the stops 11 and 12 inside the contact-making region. The contact spring arm 8 is supported by the supporting spring arm 9. The contact spring arm 8 is bent in the contact-making region, as illustrated in FIG. 9. This bending extends over the entire length of the contact spring arm 8 in order to increase the stiffness.

Figure 10:
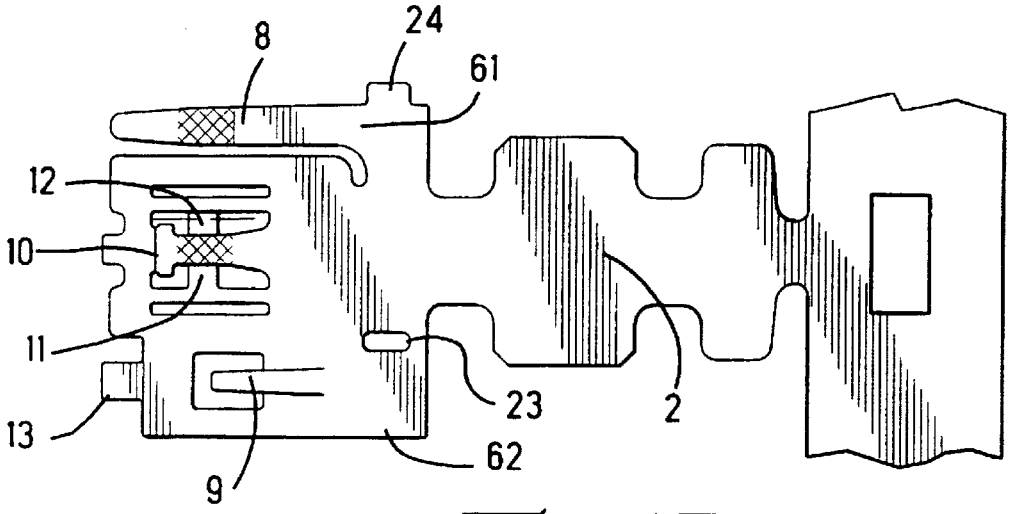
FIG. 10 shows a plan view of the layout of a contact which has been stamped out but not yet folded.

The layout of the contact according to the invention can be seen clearly in FIG. 10. The contact-making region 3 is formed by folding a number of times, the top wall being formed from two layers 61 and 62. The contact spring arm 8 is formed from the layer 61, while the supporting spring arm 9 and the lug 13 are formed from the layer 62. The stops 11 and 12 as well as the compensating leaf spring 10 are formed from the bottom wall 7. An opening 23 and a corresponding lug-24, which secures the lower layer of the wall 61 to the side wall, can be seen from the layout. The cross-hatched regions on the contact spring arm 8 and the compensating leaf spring 10 represent those regions of the contact which are gold-plated for the purpose of better contact-making.

Figure 11:
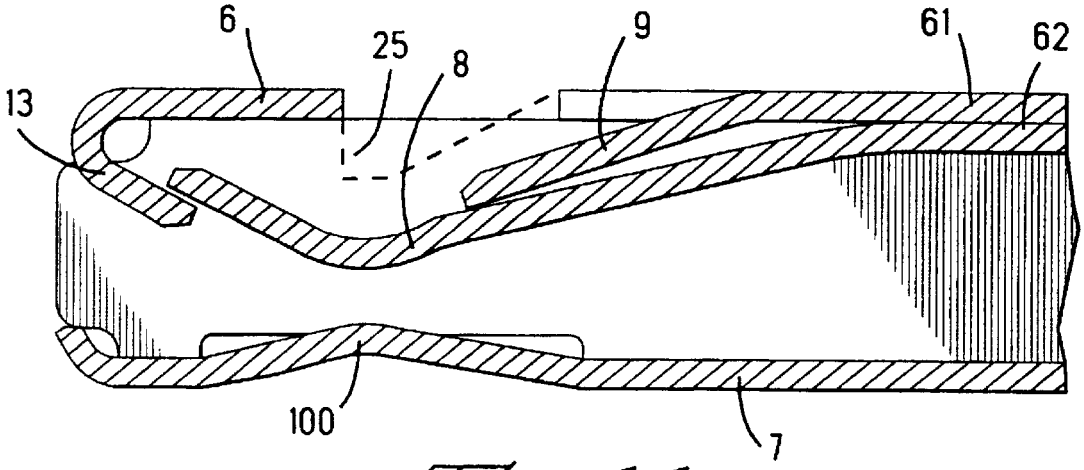
FIG. 11 shows a longitudinal section through a slightly modified contact.
Figure 12:
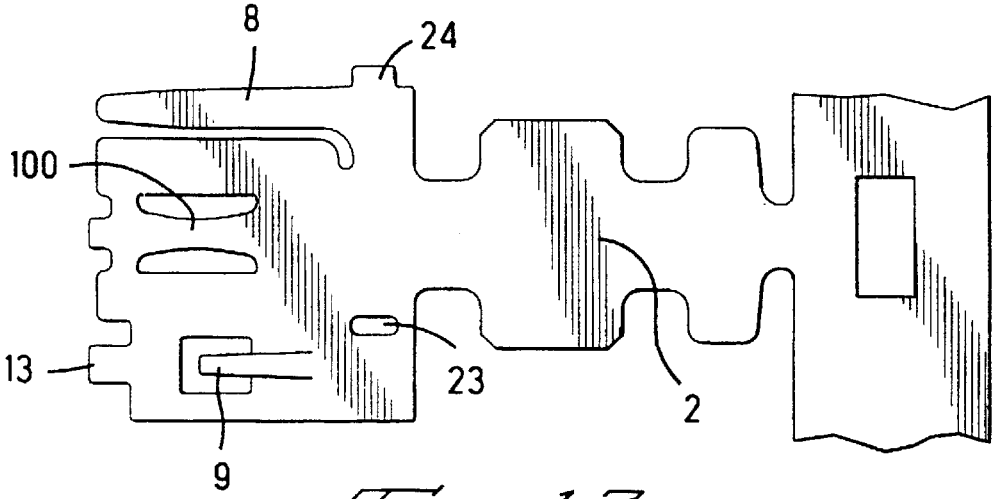
FIG. 12 shows a layout of the slightly modified contact.
Figure 14:
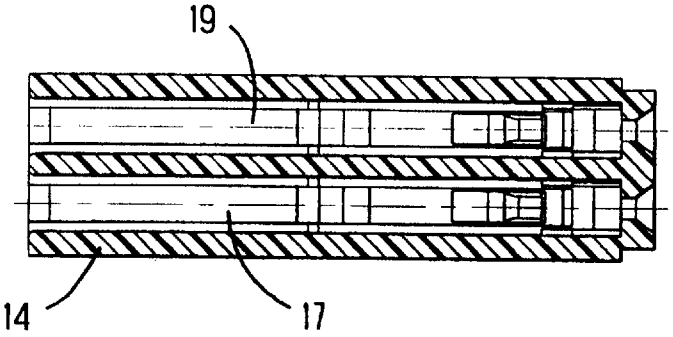
FIG. 14 shows a section along the section line BB according to FIG. 13.

FIG. 11 illustrates a longitudinal section (as in FIG. 8) through a further version of a contact and FIG. 12 illustrates a corresponding layout. These differ from the contact illustrated in FIGS. 8 and 10 in terms of the different compensating spring. The compensating leaf spring 100 illustrated is joined at both ends and cut free only on the sides. Its deflection is thereby limited and stops are not provided.

FIGS. 13 to 18 then illustrate a housing which is suitable for accommodating a contact according to the invention. The housing 14 has four contact chambers 17 to 20. The contact chambers each extend from the cable end of the housing 14 as far as the plug-in face end of the housing, where openings are provided for the introduction of complementary contact pins.

Figure 16:
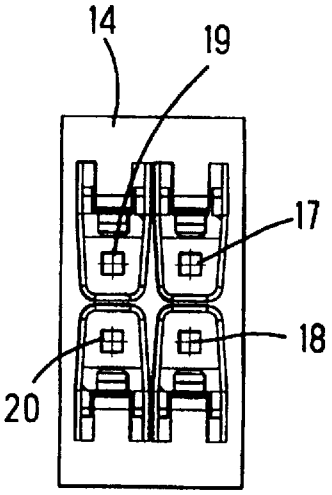
FIG. 16 shows a view of a housing from the cable end.

As emerges particularly clearly from FIG. 16, the view from the cable end of the housing, the chamber walls between the individual chambers 17 to 20 are very thin. As a result of the inventive form of the contacts, namely their trapezoidal cross-section, it is possible for the width of the chamber walls to change over the layer thereof and, as a result, for a robust region to be produced at least on one side. This enables the contacts, or the contact chambers, to be arranged as close to one another as possible.

Figure 15:
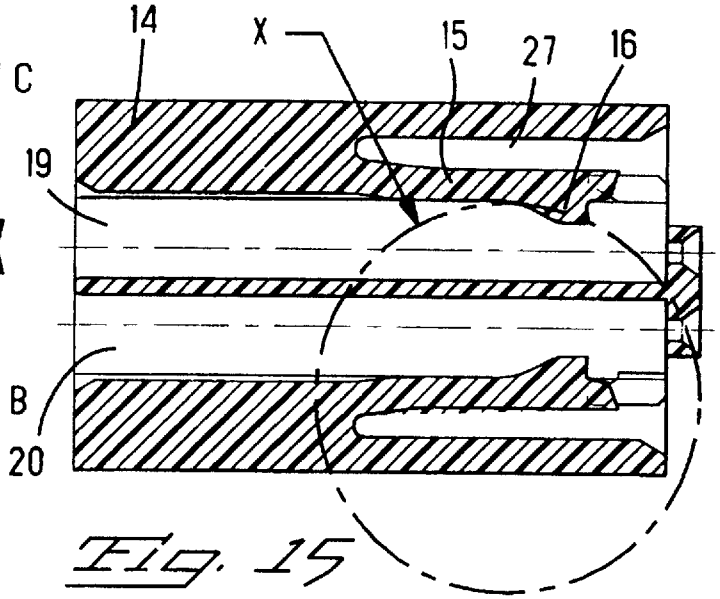
FIG. 15 shows a section along the section line AA according to FIG. 13.
Figure 13:
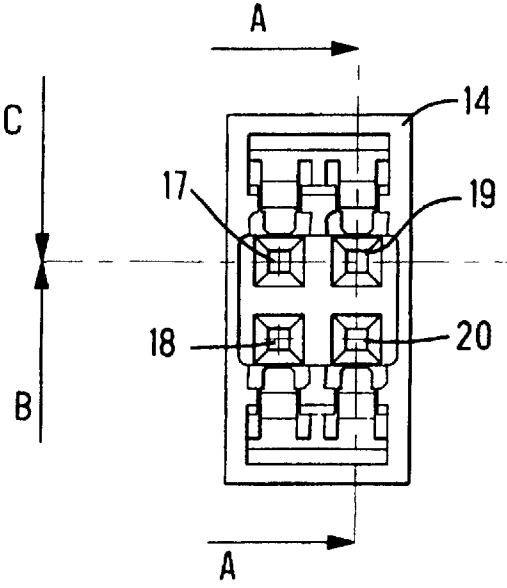
FIG. 13 shows a view of the plug-in face end of a housing.
Figure 17:
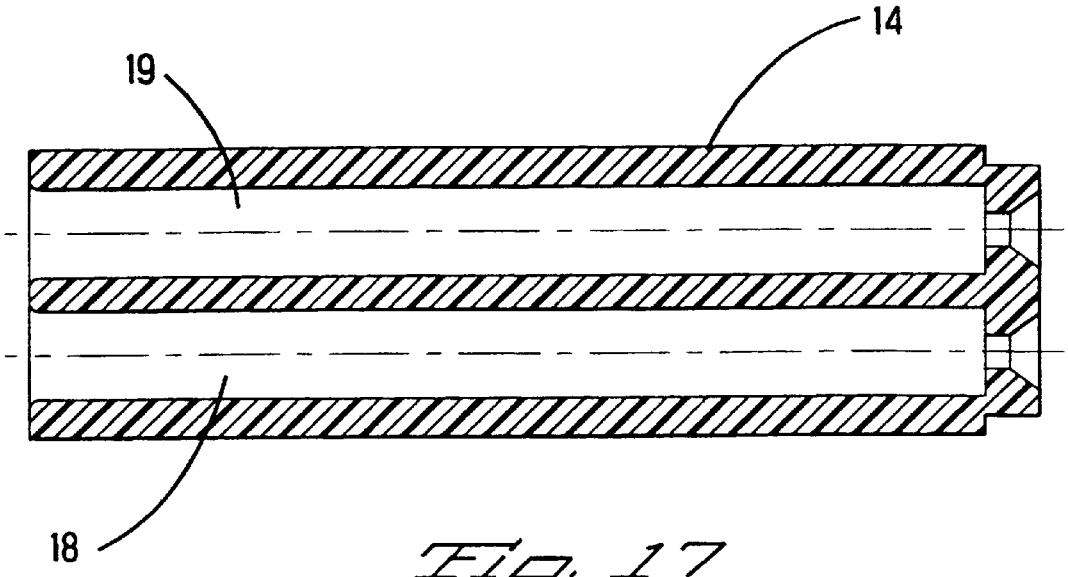
FIG. 17 shows a section along the section line CC according to FIG. 13.

From FIG. 15, it is evident that each contact chamber is assigned a flexible arm 15 having a latching lug 16 which engages in the contact chamber. When the contact is introduced, the latching lug 16 enters an opening 25 in the top wall 6 of the contact (see FIG. 1 or 8) and secures the contact in the chamber.

Figure 18:
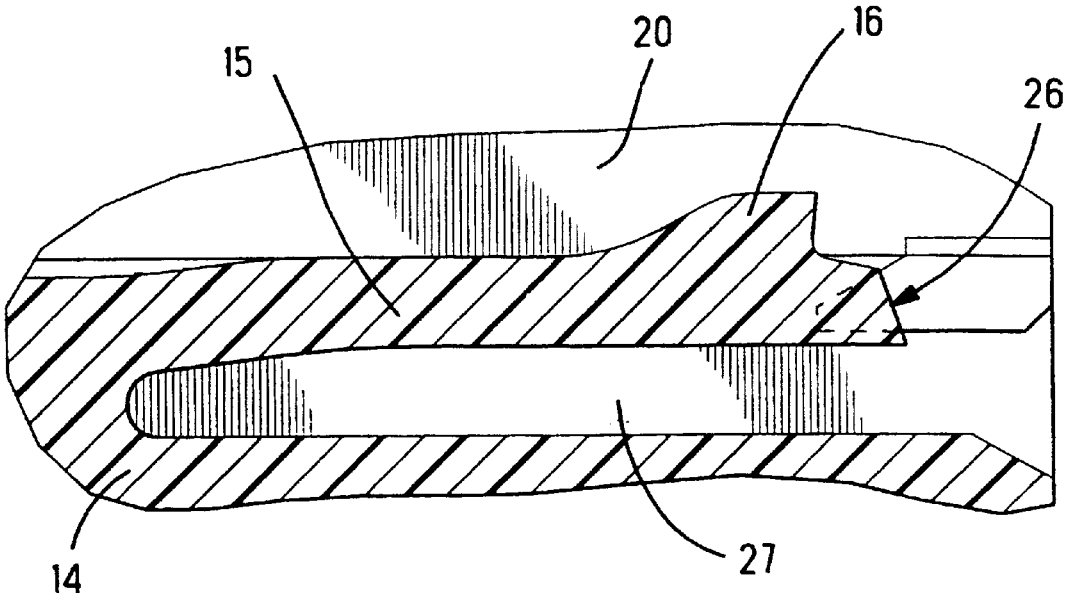
FIG. 18 shows a detailed view of the detail X according to FIG. 15.

The flexible arm 15 is illustrated once again, in detail, in FIG. 18. It can be seen here that the end face 26 of the flexible arm is bevelled. This bevelling serves the following purpose: if a contact is introduced incompletely into the contact chamber, the flexible contact arm 15 is bent outwards, that is to say out of the contact chamber. If an attempt is made in this state to connect a complementary connector to the illustrated connector, then a wall region of the complementary connector, which normally engages in the depression 27 (see FIG. 13), runs up against the oblique end face 26 of the flexible arm. The special configuration of the end face prevents the flexible arm from being pressed back into its original position by the wall region of the complementary connector even though the contact is incorrectly introduced. What is effected by this is that the flexible arm 15 is moved even further out of the chamber.

What is claimed is:

1. An electrical contact comprising a one piece construction having a conductor connection region for connection to an electrical conductor and a contact-making region for making contact with a complementary contact, the contact-making region is formed as a box by two opposing side walls, a top wall and a bottom wall, where the top wall is wider than the bottom wall and the two opposing side walls are inclined with respect to each other and the top wall and the bottom wall, the contact making region having a contact spring arm extending at an inclination toward the bottom wall in a deflectable cantilevered form from the top wall, between the opposing side walls, and converging towards the bottom wall into a contacting region that would engage a complementary contact when inserted into the contact-making region and then diverging from the bottom wall to a free end, the contact spring arm being wider where the arm emerges from the top wall than at the contacting region and being tapered to fit between opposing side walls converging from the top wall toward the bottom wall, whereby higher contact forces would be generated upon the complementary contact than if the contact arm had a constant width equal to the contacting region.

2. The electrical contact of claim 1, wherein the top wall is of double wall construction having a lower wall from which the contact arm extends and an upper wall having a supporting spring arm that overlies the contact arm.

3. The electrical contact of claim 2, wherein the contact making region has an opening for receiving the complementary contact where the contact arm and supporting spring arm extend from the lower wall and the upper wall respectively from locations closer to the conductor connection region than the opening and in a direction towards the opening.

4. The electrical contact of claim 3, wherein the box of the contact-making region is of generally trapezoidal cross-sectional construction.

5. The electrical contact of claim 4, wherein the cross section is symmetrical.

6. The electrical contact of claim 5, wherein a lug extends forward from the top wall and is bent back into the opening to define an insertion funnel.

7. The electrical contact of claim 6, wherein the lug extends from the upper wall.

8. The electrical contact of claim 1, wherein a compensating leaf spring extends into the contact making region from the bottom wall.

9. The electrical contact of claim 3, wherein a lug extends forward from the top wall and is bent back into the opening and beneath the free end such that the free end of the contact arm is located between the top wall and the lug.

10. The electrical contact of claim 8, wherein the compensating leaf spring is joined to the bottom wall at two ends thereof and free of the bottom wall along two sides thereof.

11. The electrical contact of claim 8, wherein the compensating leaf spring extends in a cantilevered manner away from the conductor connection region.

12. The electrical contact of claim 11, wherein the free end of the contact arm rests freely between the top wall and the lug.

13. The electrical contact of claim 12, wherein the lug extends from the upper wall of the top wall.

14. An electrical contact for use in an electrical connector including a housing latch to secure the electrical contact in the electrical connector, the electrical contact comprising a one piece box receptacle having a trapezoidal cross section, the box receptacle being formed by opposing side walls diverging upwardly for a bottom wall, and a top wall formed by upper and lower overlapping layers, with a cantilever contact spring arm extending from the lower layer toward the bottom wall, the lower layer being supported by one of the sidewalls behind the cantilevered contact spring arm, and a lug extending from a front edge of the upper layer being folded downward and around to extend below a forward end of the cantilever contact spring arm in supporting relationship to the cantilever contact spring arm.

15. The electrical contact of claim 14 wherein a supporting spring beam extends from the upper layer to engage the cantilever contact spring arm, both the cantilever contact spring arm and the supporting spring beam extending between opposing sidewalls.

16. The electrical contact of claim 14 wherein the contact includes an opening in the top wall above the cantilever contact spring arm, the opening comprising means for receiving a housing latch to secure the contact in the electrical connector.

17. The electrical contact of claim 14 wherein the cantilever contact spring arm is preloaded or prestressed by the lug.

18. An electrical contact for use in an electrical connector, the electrical contact comprising a one piece box receptacle being formed by opposing side walls extending upwardly from the bottom wall, and a top wall formed by upper and lower overlapping layers, with a cantilever contact spring arm extending from the lower layer toward the bottom wall and a cantilever supporting spring extending from the top layer, the lower layer being supported by one of the sidewalls behind the cantilevered contact spring arm, and a lug extending from a front edge of the upper layer being folded downward and around to extend below a forward end of the cantilever contact spring arm in supporting relationship to the cantilever contact spring arm so that the cantilever contact spring arm is held between the lug and the cantilever supporting spring prior to deflection by a mating electrical contact.

* * * * *